US007995047B2

(12) United States Patent
Mizuki et al.

(10) Patent No.: US 7,995,047 B2
(45) Date of Patent: Aug. 9, 2011

(54) CURRENT DRIVING DEVICE

(75) Inventors: Makoto Mizuki, Kyoto (JP); Kazuyoshi Nishi, Kyoto (JP); Tetsuro Ohmori, Osaka (JP); Tomokazu Kojima, Osaka (JP); Hiroshi Kojima, Kyoto (JP)

(73) Assignee: Panasonic Corporation, Osaka (JP)

( * ) Notice: Subject to any disclaimer, the term of this patent is extended or adjusted under 35 U.S.C. 154(b) by 904 days.

(21) Appl. No.: 11/954,659

(22) Filed: Dec. 12, 2007

(65) Prior Publication Data

US 2008/0143429 A1 Jun. 19, 2008

(30) Foreign Application Priority Data

Dec. 13, 2006 (JP) ..... 2006-335850

(51) Int. Cl.
*G05F 1/10* (2006.01)

(52) U.S. Cl. ..... 345/204; 327/108

(58) Field of Classification Search ..... 345/76, 345/204; 327/108
See application file for complete search history.

(56) References Cited

U.S. PATENT DOCUMENTS

| | | | | |
|---|---|---|---|---|
| 6,594,606 | B2 | 7/2003 | Everitt | |
| 6,628,274 | B1 * | 9/2003 | Morita | 345/209 |
| 6,765,560 | B1 * | 7/2004 | Ozawa | 345/204 |
| 6,777,885 | B2 * | 8/2004 | Koyama | 315/169.1 |
| 6,882,186 | B2 * | 4/2005 | Nishitoba | 327/108 |
| 7,012,597 | B2 * | 3/2006 | Kasai | 345/204 |
| 7,050,024 | B2 | 5/2006 | LeChevalier | |
| 7,064,969 | B2 * | 6/2006 | West | 363/132 |
| 7,221,349 | B2 * | 5/2007 | Hashido et al. | 345/89 |
| 7,466,166 | B2 * | 12/2008 | Date et al. | 327/108 |
| 7,864,167 | B2 * | 1/2011 | Morosawa et al. | 345/204 |
| 2002/0135314 | A1 * | 9/2002 | Kitahara et al. | 315/169.3 |
| 2004/0108988 | A1 * | 6/2004 | Choi | 345/96 |
| 2004/0239668 | A1 * | 12/2004 | Morosawa et al. | 345/212 |
| 2004/0251844 | A1 | 12/2004 | Hashido et al. | |
| 2005/0231241 | A1 | 10/2005 | Date et al. | |
| 2006/0158402 | A1 | 7/2006 | Nathan et al. | |

FOREIGN PATENT DOCUMENTS

| | | |
|---|---|---|
| JP | 2004-219955 | 8/2004 |
| JP | 2005-121843 | 5/2005 |
| JP | 2005-311591 | 11/2005 |

* cited by examiner

*Primary Examiner* — Bipin Shalwala
*Assistant Examiner* — Afroza Chowdhury
(74) *Attorney, Agent, or Firm* — McDermott Will & Emery LLP

(57) ABSTRACT

A current driving device comprises: a voltage supply part; a current supply part; and a plurality of current output parts, each comprising a current-voltage converting function, a voltage-current converting function, and a voltage holding capacitance element. The current output part takes three operation modes. Under a voltage supply mode, the current output part receives a voltage from the voltage supply part and holds the voltage in the voltage holding capacitance element. Under a current supply mode, the current output part receives the current from the current supply part, generates a second voltage by the current-voltage converting function and holds the voltage in the voltage holding capacitance element. Under a current output part, the current output part outputs an output current according to the voltage held in the voltage holding capacitance element by the voltage-current converting function. By charging the current output part with the reference voltage before the calibration performed by using the reference current, calibration of the current output part is performed at a high speed.

10 Claims, 9 Drawing Sheets

CURRENT DRIVING DEVICE

FIELD OF THE INVENTION

The present invention relates to a current driving device used preferably as a driver for displays such as organic EL (Electro-luminescence) panels, LED panels, and the like.

BACKGROUND OF THE INVENTION

Recently, flat-panel displays have a larger screen and higher definition, while establishing reduction in thickness, weight, and cost. With such backgrounds, it is required for display drivers to improve the uniformity in the displayed image qualities through decreasing variations between output electric currents that are outputted from output terminals. Variations in the electric currents in static actions of current mirrors include variations caused due to fabrication processes of each transistor, variations of gate voltages caused due to resistances of power supply wirings, and the like. Further, variations due to dynamic actions of the current mirrors include variations caused due to injection of electric charges from a display panel or instantaneous fluctuations of power supply, for example. Furthermore, generally, a driver IC is formed in a multi-output structure with a stick-like slim shape, since it is mounted to a frame part of a flat panel. Because of restrictions in the LSI shape, characteristics of transistors disposed therein vary depending on positions of slim-layout elements. Therefore, even if a same gate voltage is applied in a current mirror structure, the output currents from each of current-summing DA converter circuits do not necessarily become the same.

As a method for decreasing such variations, there is a current driving device having a current output part, such as the one shown in FIG. 6A and FIG. 6B, for example (see US 2005/0231241A1, for example). This current output part has a calibration function and a current output function. "Calibration" means to have a reference current value by a reference current source stored in the current output part.

Under a calibration mode, current output switches So1 and So2 are set to a nonconductive state, while a current input switch Sw1, a calibration switch Sw2, and all signal response switches G1-Gm are set to a conductive state. Current output terminals T1 and T2 are isolated from the outside. Nodes N1 and N2 are short-circuited, and drains and gates of Nch transistors QN1-QNm are short-circuited to receive electric currents from a reference current source I1. Through this, the Nch transistors QN1-QNm generate, at the node N2, a gate voltage that is necessary for allowing the electric current from the reference current source I1 to flow through the transistors themselves. A voltage holding capacitance element C1 is charged to the above-described gate voltage. A voltage V (N2) of the node N2 corresponds to a voltage that is capable of passing an electric current that is equal to the reference current generated by the reference current source I1 through the Nch transistors QN1-QNm which are all in a conductive state. In conclusion, the current output part A comes to store the reference current generated by the reference current source I1.

Under a current output mode, the current input switch Sw1 and the calibration switch Sw2 are turned to a nonconductive state, and either one of the current output switch So1 or So2 is set to a conductive state while the other is remained in a nonconductive state. The conduction state of the signal response switches G1-Gm is determined depending on an input signal supplied from the outside. The voltage holding capacitance element C1 holds the voltage charged by the calibration action, and continues to supply the electric current to the gate terminals of the Nch transistors QN1-QNm. The Nch transistors QN1-QNm output an electric current in accordance with the voltage V (N2) of the node N2 from one (in an conductive state) of the current output terminals T1 and T2, in accordance with the conduction state of the signal response switches G1-Gm.

FIG. 7 shows a timing chart of a series of actions regarding calibration and output of the electric current performed in the current-summing DA converter circuit shown in FIG. 6A and FIG. 6B. The conductive state of the switches is shown with "H", and the nonconductive state thereof is shown with "L". "V (N2)" indicates the voltage V (N2) of the node N2.

Before calibration, the current output part A sets the current output witch So1 to be in a conductive state, and outputs, from the current output terminal T1, the output current in accordance with the state of the signal response switches G1-Gm which are controlled by the voltage V (N2) of the node N2 and an input signal. The current output switch So2, the current input switch Sw1, and the calibration switch Sw2 are set to be in a nonconductive state.

During the calibration period, the current output switches So1, So2 are set to a nonconductive state, the current input switch Sw1 and the calibration switch Sw2 are set to a conductive state, and the signal response switches G1-Gm for selecting the electric currents from the Nch transistors QN1-QNm are all set to a conductive state. Through this, the Nch transistors QN1-QNm are set in a state where only the electric current of the reference current source I1 is supplied, and the voltage V (N2) of the node N2 is determined in accordance with the above-described actions.

After completing the above-described calibration, the current input switch Sw1 and the calibration switch Sw2 are set to a nonconductive state, so that the voltage holding capacitance element C1 holds the electric charge. That is, the voltage V (N2) of the node N2 is being maintained. Thereafter, the current output switch So2 is set to a conductive state, and the sum of the electric currents selected by the signal response switches G1-Gm in accordance with the input signal is outputted from the current output terminal T2.

FIG. 8 shows a structure of a current driving device that utilizes the current output part A shown in FIG. 6A and FIG. 6B. (n+1)-numbers of current output parts A0-An control the operation states under a calibration mode and a current output mode in accordance with control signals supplied from an action control circuit B. A signal input circuit Din supplies signals for controlling the signal response switches G1-Gm within the internal structural elements (see FIG. 6A) of each of the current output parts A0-An. Calibration by the reference current source I1 is performed on a single current output part among the (n+1)-numbers of current output parts A0-A1 by an internal operation of each of the current output parts A0-An. Calibration is performed in order from A0, to A1, A2, - - - , and to An. The current output parts that are not under calibration are set to be in the current output mode, and output an electric current to n-numbers of output terminals OUT1-OUTn. The electric currents are outputted in order from A0 to A1, A2, - - - , and to An.

The reference current, when there are a plurality of current-summing DA converter circuits with the above-described current output parts, can be combined into the electric currents of the same current source. This makes it possible to achieve the uniformity in the display on a panel.

Other related documents are: Japanese Unexamined Patent Publication 2004-219955, Japanese Unexamined Patent Publication 2005-121843, US2004/0251844A1, US7050024B2, US6594606B2, US2006/0158402A1.

With this method, however, the capacity for charging/discharging the voltage holding capacitance element C1 becomes insufficient when the current value of the reference current source I1 is very small, so that it is difficult to charge the current of the Nch transistors QN1-QNm to accurately meet the value of the current from the reference current source I1 within the calibration period. FIG. 9 shows the state where the voltage holding capacitance element C1 is insufficiently charged because the reference current is very small.

Further, when there is a change in the current value of the reference current source I1, the reference currents become varied depending on the output terminals with the successive calibration, until the reference currents of all the current output parts A0-An are updated.

SUMMARY OF THE INVENTION

An object of the present invention therefore is to provide a current driving device which can perform calibration at a high speed and improve the non-uniformity of the output currents even when a reference current is very small and when there is a change in the reference current.

A current driving device of the present invention comprises:

a first voltage supply part for supplying a first voltage;

a first current supply part for supplying a first electric current;

a plurality of output terminals; and a plurality of current output parts for outputting an electric current in accordance with the first electric current, each of the current output parts comprising a current-voltage converting function, a voltage-current converting function, a voltage holding part, and at least one current output terminal, wherein the current output part takes three operation modes, i.e. a voltage supply mode, a current supply mode, and a current output mode, under the voltage supply mode, the current output part receives the first voltage from the first voltage supply part and holds the voltage in the voltage holding part, under the current supply mode, the current output part receives the first current from the first current supply part, and generates a second voltage by the current-voltage converting function and holds the voltage in the voltage holding part, and under the current output mode, the current output part outputs an output current according to the voltage held in the voltage holding part by the voltage-current converting function. The voltage supply mode and the current supply mode correspond to the calibration mode.

In the current driving device constituted in the manner described above, the current output part receives a supply of the first voltage from the first voltage supply part under the voltage supply mode, and holds the first voltage in the voltage holding part. Then, under the current supply mode, the current output part receives a supply of the first electric current from the first current supply part, generates the second voltage by the current-voltage converting function, and holds the second voltage in the voltage holding part. This makes it possible to charge the voltage holding part to a prescribed voltage at a higher speed. Then, under the current output mode, the current output part outputs an electric current according to the voltage held in the voltage holding part through the voltage-current converting function. For charging the voltage holding part, it is charged with the first voltage to a value close to the target voltage, and then charged further with a supply of the first electric current. Thus, even if the reference current supplied from the first current supply part is very small, it is possible to speed up the action for supplying the voltage to the voltage holding part until reaching the reference current and also to obtain the reference current accurately.

In the current driving device with the above-described structure, each of the output terminals is connected to the current output terminals provided to the plurality of the current output parts, and each of the plurality of current output parts is connected in parallel to the first current supply part and the first voltage supply part used in common. With this structure, the voltage holding parts provided to all the current output parts can be charged provisionally to the first voltage when it becomes necessary to perform extensive calibrations on all the current output parts, e.g. right after the startup or when there is a change in the first electric current. Therefore, it is possible to suppress unevenness in the display caused due to the change in the first electric current.

Further, in the current driving device with the above-described structure, each of the current output parts actuates the current-voltage converting function under the voltage supply mode. With this structure, for charging the voltage holding part, the voltage obtained by converting the first electric current from the first current supply part can be combined with the supply of the first voltage from the first voltage supply part. Therefore, still higher speed charging can be achieved.

Furthermore, in the current driving device with the above-described structure, each of the current output parts comprises a function of stopping the current-voltage converting function under the voltage supply mode. With this structure, all the electric currents supplied from the first voltage supply part can be utilized for charging the voltage holding part. Thus, the power consumption can be reduced.

Moreover, the current driving device with the above-described structure further comprises a second current supply part for supplying a second electric current that is proportional to the first electric current, and a current-voltage converting part for generating the first voltage by receiving the second electric current, wherein the first voltage supply part controls supplies of the first voltage generated by the current-voltage converting part to the current output parts. With this structure, the first voltage supplied from the first voltage supply part to the current output part is generated from the second electric current by the current-voltage converting part. The second electric current from the second current supply part is proportional to the first electric current, so that the first voltage comes to have a value that corresponds to the first electric current. Therefore, it is possible to generate the first voltage having a value that almost equals to the final target value to be held in the voltage holding part.

Further, in the current driving device with the above-described structure, the current-voltage converting part comprises a switching part for short-circuiting a node at which the first voltage emerges to a reference voltage node. When there is a change in the first electric current or the second electric current, it also takes time to change the second voltage generated by the current-voltage converting part. With this structure, however, the output voltage of the current-voltage converting part can be reset through actuating the switching part. Therefore, it is possible to speed up the change of the second voltage by the current-voltage converting part.

Furthermore, the current driving device with the above-described structure further comprises a second voltage supply part with a larger voltage supply capacity than that of the first voltage supply part, wherein the use of the first voltage supply part and the use of the second voltage supply part are switched in accordance with the number of the current output parts that take the voltage supply mode among the plurality of current output parts. When there are a large number of current output parts, the load of the voltage supply part changes largely depending on how many current output parts are under the voltage supply mode. With this structure, however, it is possible to reduce EMI (electromagnetic interference) and the power consumption by changing the output voltages smoothly through adding the second voltage supply part and switching between the use of the first voltage supply part and the use of the second voltage supply part in accordance with the load.

Alternatively, in the current driving device with the above-described structure, the first voltage supply part is constituted to be capable of changing its voltage supply capacity in accordance with the number of the current output parts that take the voltage supply mode among the plurality of current output parts. With this structure, it is possible to reduce EMI (electromagnetic interference) and the required area because the first voltage supply part is provided with the function of optimizing the voltage supply capacity in accordance with the load.

A display device according to the present invention related to the current driving device described above comprises one of the above-described current driving devices mounted thereon so as to be driven by the current driving device. Displays on the screen can be made uniform with this display device.

A current driving device according to the present invention comprises:

- a current input switch for controlling connection/disconnection states with respect to a current supply part;
- a voltage holding part for holding a reference voltage, which is charged by a flown current;
- a calibration switch interposed between the current input switch and the voltage holding part;
- a plurality of voltage-current converting elements for generating an electric current in accordance with the reference voltage held in the voltage holding part;
- a plurality of signal response switches that are on/off controlled in accordance with inputted signals, the response switches being connected in series to each of the voltage-current converting elements, and each of which being connected in parallel to the calibration switch;
- a plurality of current output switches, each being interposed between a connection node, which is provided between the current input switch and the calibration switch, and the plurality of current output terminals; and
- a high-speeding switch for controlling connection/disconnection states of the voltage supply part with respect to the voltage holding part.

The calibration mode comprises two stages, i.e. the voltage supply mode and the current supply mode. In the voltage supply mode, the high-speeding switch is set to be in a conductive state to connect the voltage supply part to the voltage holding part in order to boost up the potential level of the voltage holding part at a high speed. At that time, the current output switches are all set to be in a nonconductive state, and the calibration switch and all the signal response switches are set to be in a conductive state. Then, in the current supply mode, the high-speeding switch is turned to a nonconductive state. The current input switch and the calibration switch are set to be in a conductive state, so that the sum of the current values flown in the voltage-current converting element becomes equal to the reference current value that is supplied from the current supply part. Thus, the voltage holding part comes to hold the voltage that corresponds to passing the current (equivalent to the reference current value) through the voltage-current converting element. That is, the reference current value is stored. As described, the potential of the voltage holding part is raised at a high speed by using the voltage supply part under the voltage supply mode that is the first half part of the calibration mode, and the reference current value by the current supply part is stored accurately in the latter half stage of the calibration mode. Therefore, even when the current value of the reference current source is very small, it becomes possible with the voltage supply part to compensate for the capacity for supplying the voltage to the voltage holding part till reaching the reference current and to complete the calibration at a high speed for allowing the current flowing the voltage-current converting element to meet accurately with the current value of the reference current source.

BRIEF DESCRIPTION OF THE DRAWINGS

The present invention is illustrated be way of example and not limitation in the figures of the accompanying drawings, in which like references indicate similar elements and in which.

DETAILED DESCRIPTION OF THE INVENTION

Figure 1A:
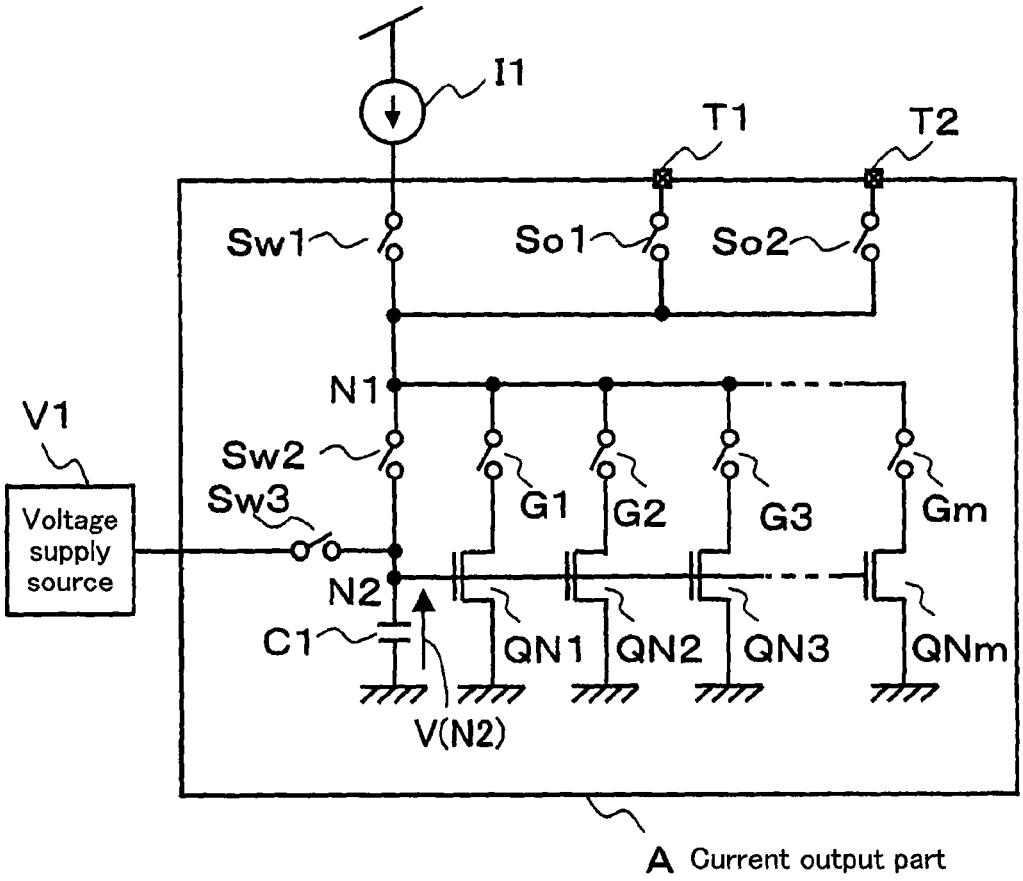
FIG. 1A is a circuit diagram for showing a structure of a current output part according to a preferred embodiment of the present invention.

Hereinafter, an embodiment of a current driving device according to the present invention will be described in detail by referring to the accompanying drawings. Same reference numerals are applied to the same or corresponding components within the drawings.

Figure 1B:
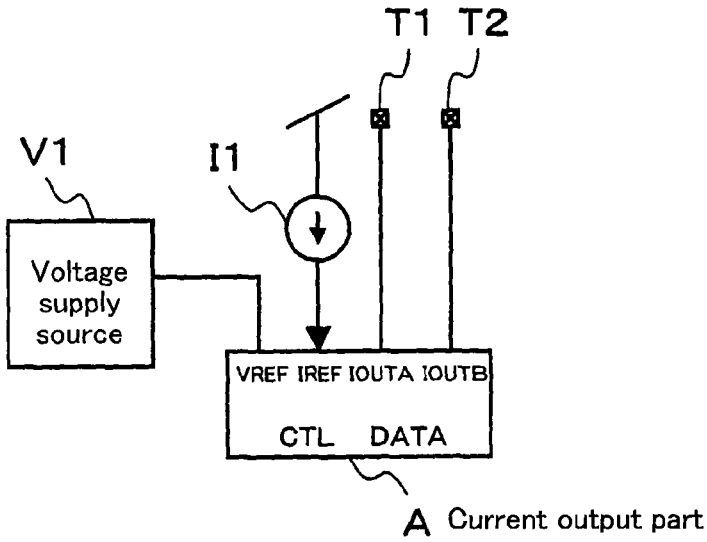
FIG. 1B is a block circuit diagram for showing the structure of the current output part according to the preferred embodiment of the present invention.
Figure 2:
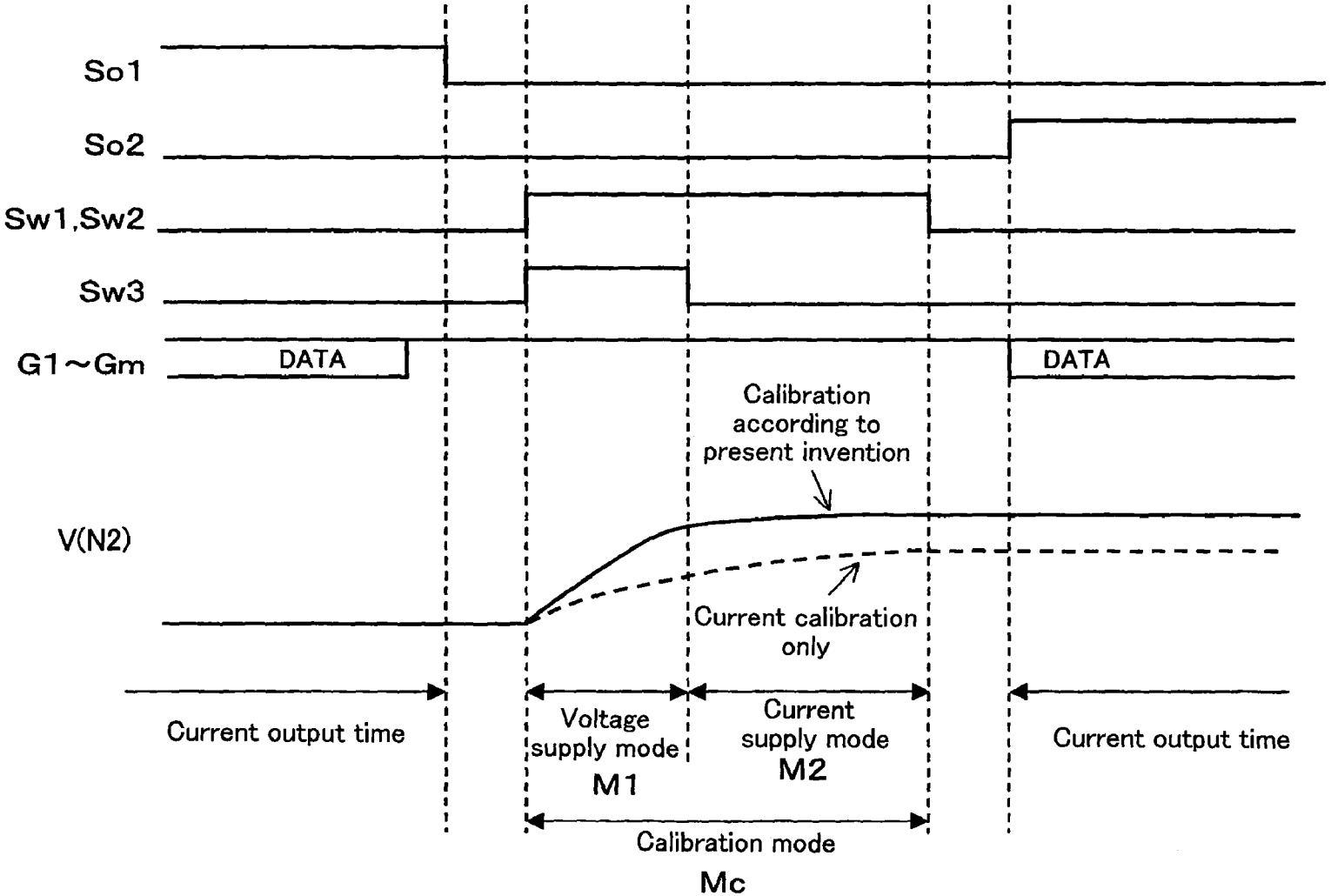
FIG. 2 is a timing chart for showing actions of the current output part shown in FIG. 1A and FIG. 1B.
Figure 3:
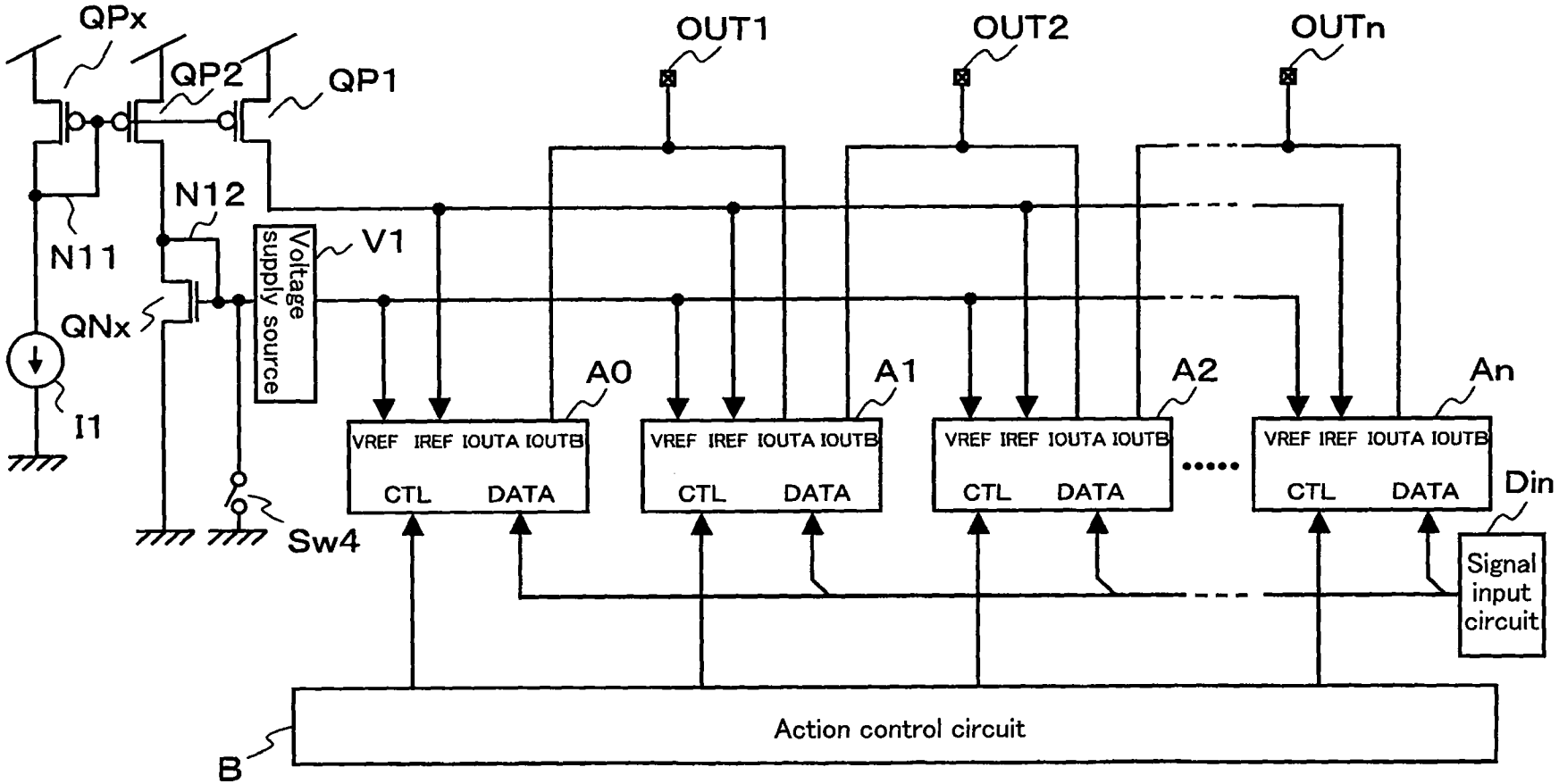
FIG. 3 is a block circuit diagram for showing an overall structure of a current driving device according to the preferred embodiment of the present invention.
Figure 4:
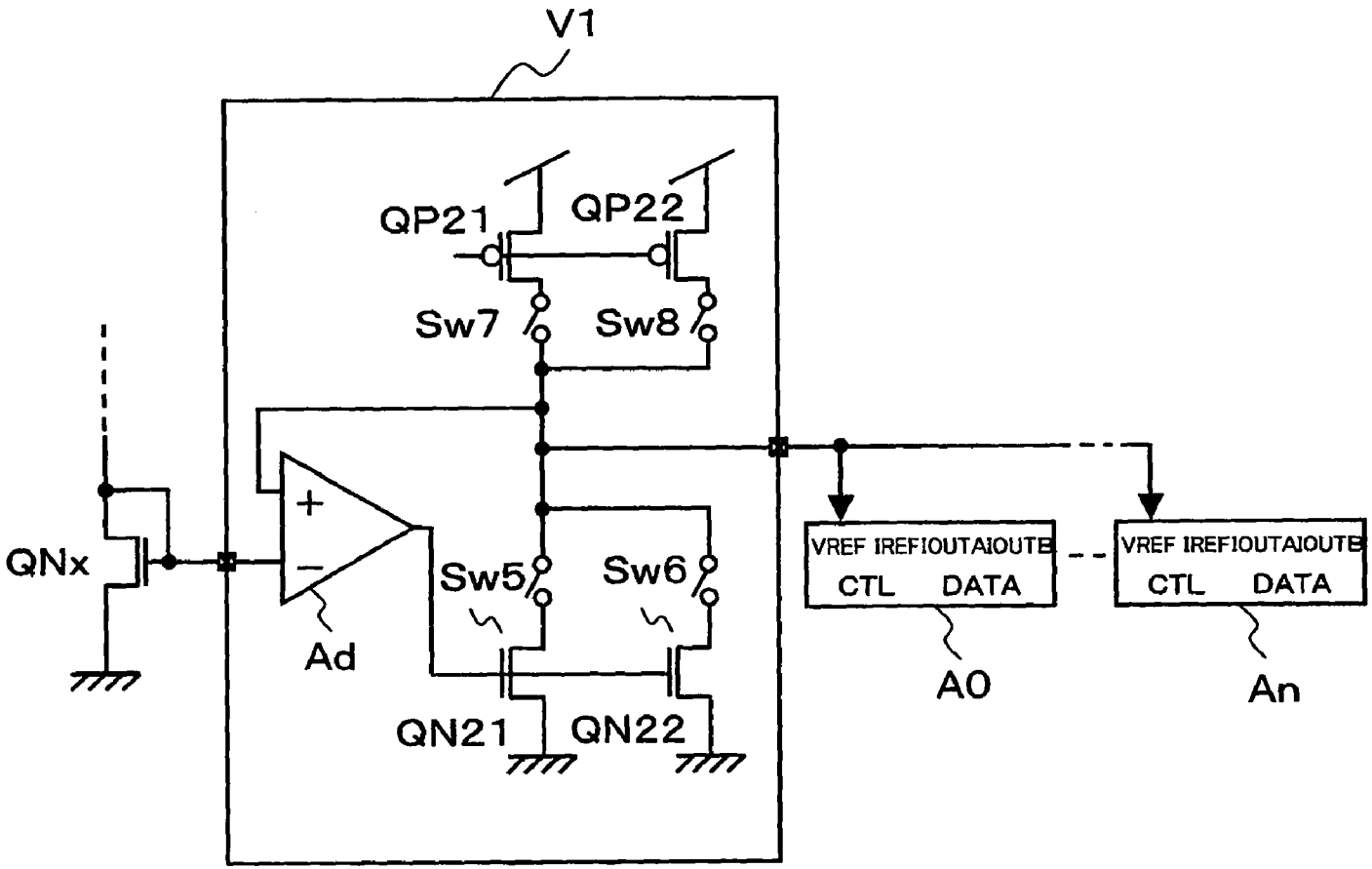
FIG. 4 is a circuit diagram for showing a specific structure of a voltage supply source according to the preferred embodiment of the present invention.

FIG. 1A is a circuit diagram for showing a structure of a current output part A that is mounted to a current driving device according to a preferred embodiment of the present invention, FIG. 1B is a block circuit diagram for showing the structure of the current output part A, FIG. 2 is a timing chart for describing actions of the current output part A, FIG. 3 is a block circuit diagram for showing the overall structure of the current driving device, and FIG. 4 is a circuit diagram for showing an embodiment of a voltage supply source V1.

<Current Output Part>

Figure 6A:
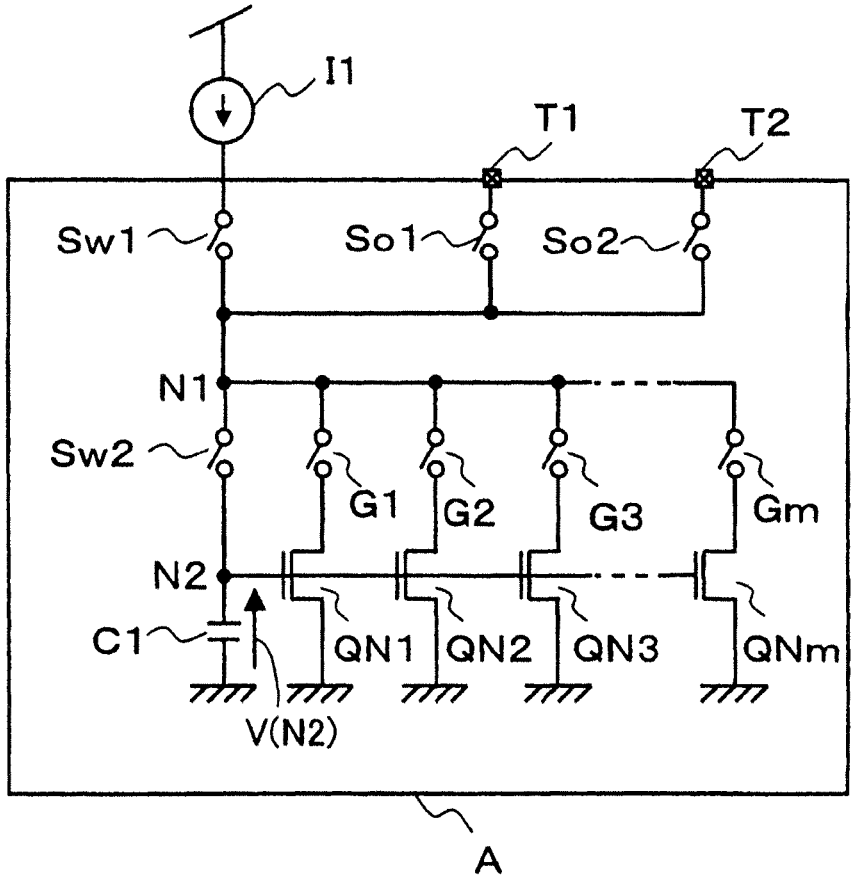
FIG. 6A Prior Art
FIG. 6A is a circuit diagram for showing a structure of a current output part according to a conventional technique.
Figure 6B:
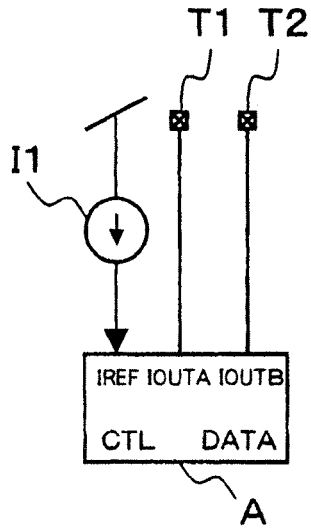
FIG. 6B Prior Art
FIG. 6B is a block circuit diagram for showing the structure of the current output part according to the conventional technique.
Figure 7:
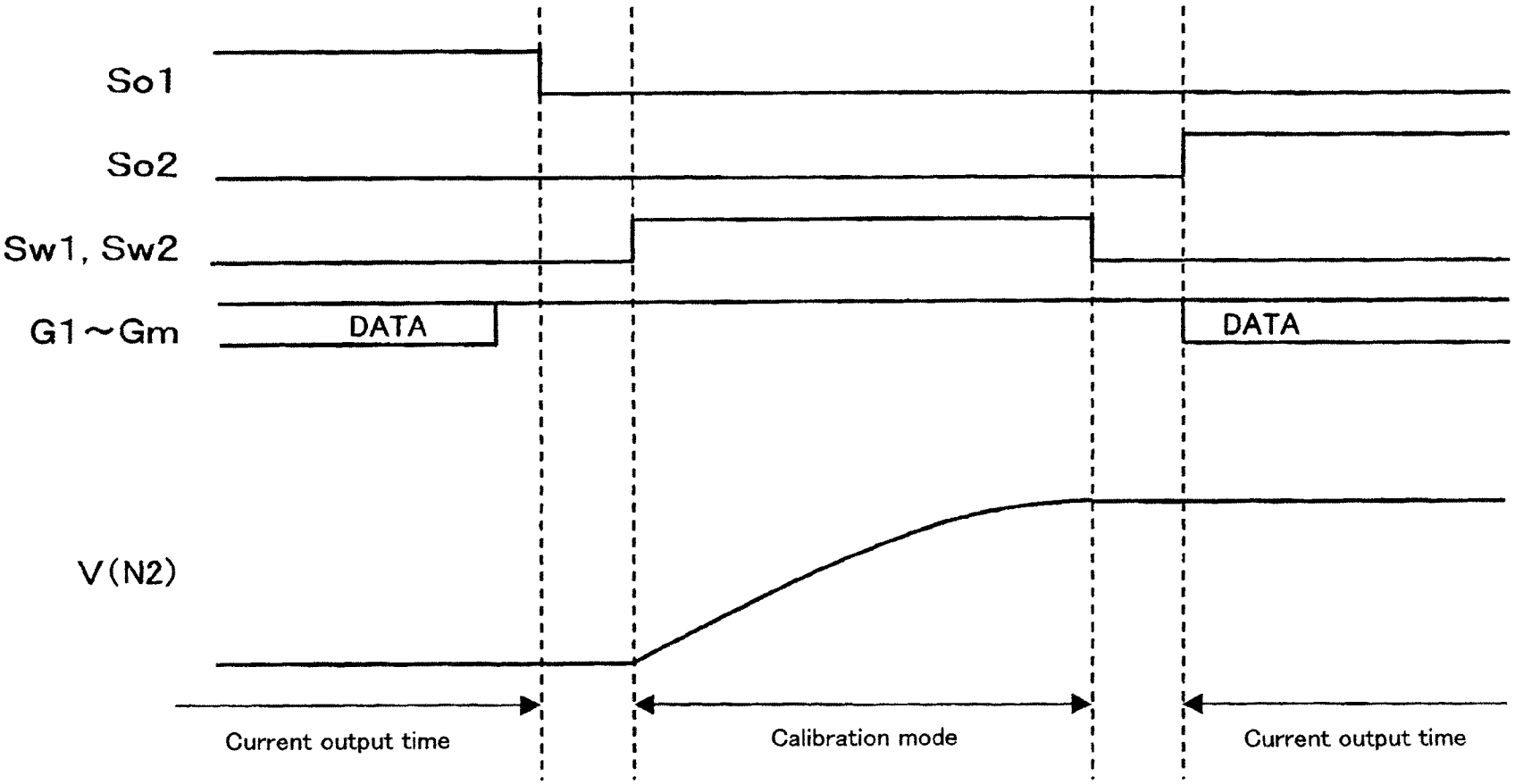
FIG. 7 Prior Art
FIG. 7 is a timing chart for showing actions of the current output part shown in FIG. 6A and FIG. 6B.
Figure 8:
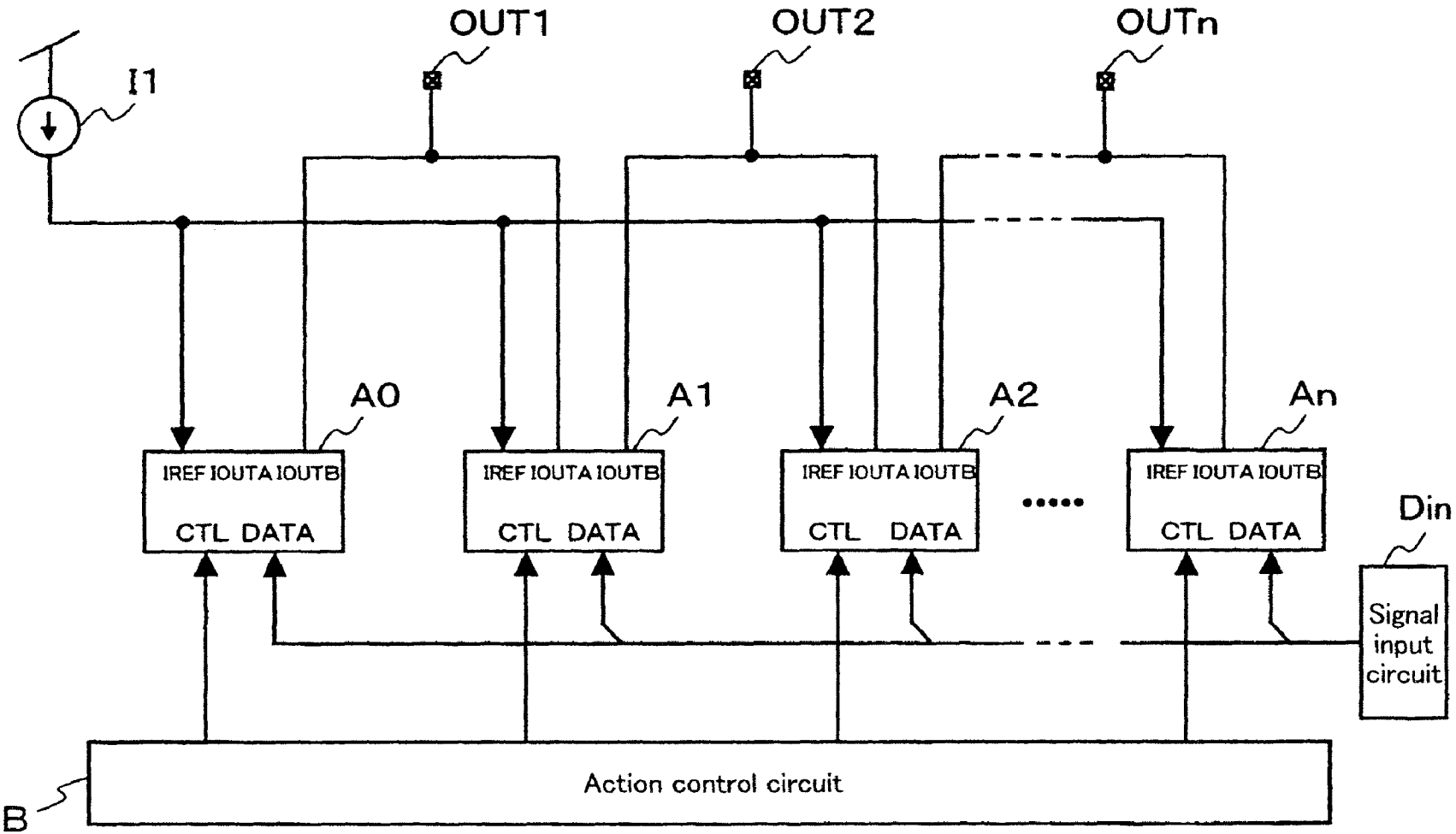
FIG. 8 Prior Art
FIG. 8 is a block circuit diagram for showing an overall structure of a current driving device according to the conventional technique.
Figure 9:
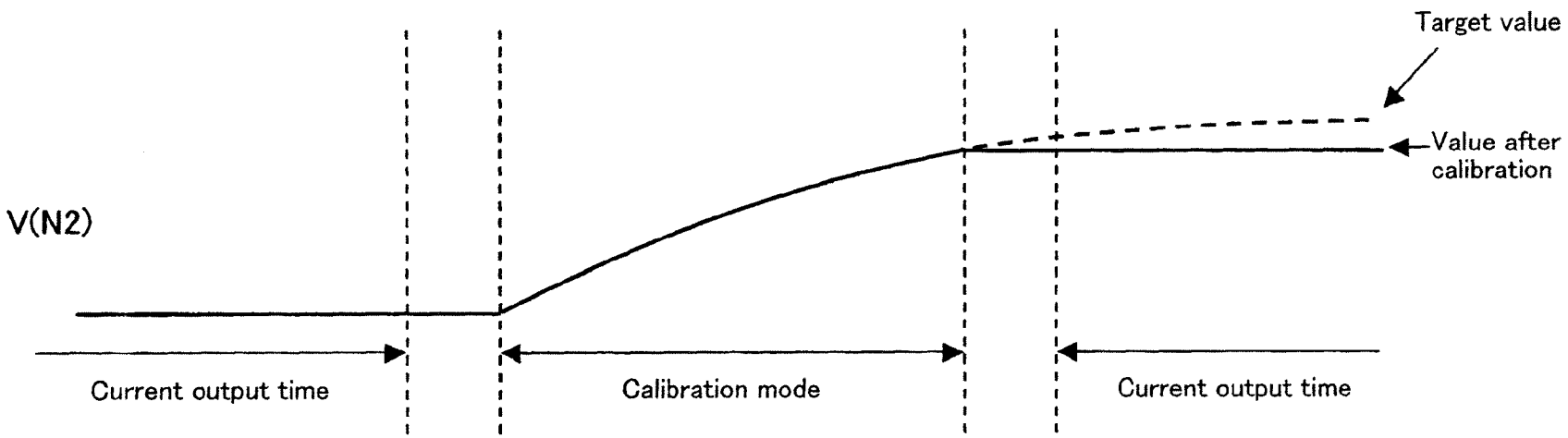
F I G. 9 Prior Art
FIG. 9 is a timing chart for showing actions of the current output part shown in FIG. 6A and FIG. 6B, when a reference current is very small.

First, the current output part A will be described by referring to FIG. 1A and FIG. 1B. One end of a voltage holding capacitance element C1 is connected to a ground terminal, and the other end is connected in common to gate terminals of m-numbers of Nch transistors QN1-QNm. Each source of the Nch transistors QN1-QNm is connected to a ground terminal, and each drain thereof is connected in series to signal response switches G1-Gm which are ON/OFF controlled in accordance with input signals. The other ends of the signal response switches G1-Gm are connected in common, and are also connected, via a current input switch Sw1, to a reference current source I1 that supplies a constant current value (first electric current) to the current output part A, while being connected to the voltage holding capacitance element C1 via a calibration switch Sw2. A node N1 for connecting the current input switch Sw1, the calibration switch Sw2, and the signal response switches G1-Gm is connected to current output terminals T1 and T2 via current output switches So1 and So2, respectively. The circuit structure that has been described heretofore is the same as the circuit structure of a conventional technique shown in FIG. 6A and FIG. 6B.

In this embodiment, further, a voltage supply source V1 for supplying a constant voltage (first voltage) to the current output part A is connected, via a high-speeding switch Sw3, to a node N2 that is a connection between the voltage holding capacitance element C1 and the calibration switch Sw2. The voltage supply source V1 corresponds to a first voltage supply part. The reference current source I1 corresponds to a first current supply part. The voltage holding capacitance element C1 corresponds to a voltage holding part. As the voltage holding capacitance element C1, a parasitic capacitance provided originally to the gate terminals of the Nch transistors QN1-QNm may be used instead.

This current output part A takes three operation states such as a voltage supply mode M1, a current supply mode M2, and a current output mode M3. Among those, the voltage supply mode M1 and the current supply mode M2 constitute a calibration mode Mc.

<<Voltage Supply Mode M1>>

Now, the voltage supply mode M1 of the current output part A will be described first.

First, each of the current output switches So1 and So2 is set to a nonconductive state, so that the current output terminals T1 and T2 are isolated from the node N1. Further, the high-speeding switch Sw3 is set to a conductive state, so that the voltage supply source V1 and the node N2 are connected. At this time, the voltage holding capacitance element C1 is charged to a constant voltage (this corresponds to the first voltage, and will be referred to as a reference voltage hereinafter) that is supplied from the voltage supply source V1.

It is also possible that the current supply mode M2 to be described next is activated simultaneously with the voltage supply mode M1. In that case, the current input switch Sw1, the calibration switch Sw2, and all the signal response switches G1-Gm are set to be in a conductive state.

<<Current Supply Mode M2>>

Next, the current supply mode M2 of the current output part A will be described. Under this current supply mode M2, a current-voltage converting function is actuated. Thus, the current input switch Sw1, the calibration switch Sw2, and all the signal response switches G1-Gm are set to be in a conductive state. The high-speeding switch Sw3 is turned to a nonconductive state so that the node N2 is isolated from the voltage supply source V1. The current output switches So1 and So2 are remained in the nonconductive sate.

At this time, the drains and gates of the Nch transistors QN1-QNm are connected, thereby exhibiting a diode characteristic. Therefore, the Nch transistors QN1-QNm have an electric current (reference current) with a constant current value from the reference current source I1 flown therein as a load. At this time, a gate voltage for passing the electric current from the reference current source I1 is generated uniquely at the gates of the Nch transistors QN1-QNm. Therefore, the voltage holding capacitance element C1 accumulates the electric charges in accordance with the gate voltages. As described, the voltage holding capacitance element C1 holds the gate voltage for allowing the electric current with the same current value as that of the reference current to be flown. The current output part A stores the reference current value.

<<Current Output Mode M3>>

Next, the current output mode M3 of the current output part A will be described. Under this current output mode M3, a voltage-current converting function is actuated. Thus, the current input switch Sw1 and the calibration switch Sw2 are set to be in a nonconductive state, and either the current output switches So1 or So2 is turned to a conductive state from a nonconductive state. The output switches So1 and So2 are not set to be in a conductive state simultaneously. The high-speeding switch Sw3 is remained in the nonconductive state. The voltage holding capacitance element C1 has an accumulation of the electric charges in accordance with the gate voltages for allowing the electric current with the same current value as that of the reference current to be flown under the above-described current supply mode M2. A gate voltage according to the electric charges accumulated in the voltage holding capacitance element C1 is applied to the gates of the Nch transistors QN1-QNm. Thus, it is possible to output a sink current having a current value proportional to the reference current in accordance with the conduction states of the current output switches So1, So2 and the signal response switches G1-Gm, through connecting a power source to the current output terminal T1 or the current output terminal T2. The output current also depends on the conduction states of the signal response switches G1-Gm, which is the sum of the electric currents outputted from the Nch transistors whose signal response switches G1-Gm (connected to each transistor) are in a conductive state among the output currents from the Nch transistors QN1-QNm. If all the signal response switches G1-Gm are in a conductive state, the output current obtained thereby is the maximum output current of the current output parts A under execution of the above-described current supply. The value thereof equals to the reference current.

Through a series of these actions, it becomes possible to copy the reference current to the current output part A and to output the electric current in accordance with the reference current and an input signal. The electric current can be copied with only the current supply mode M2 and the current output mode M3. However, with the voltage supply mode M1, an insufficient charge of the voltage holding capacitance element C1 can be overcome and the electric current can be copied at a higher speed by charging the voltage of the Node N1 that is connected to the gate terminals of the Nch transistors QN1-QNm to a value close to a target voltage (convergent voltage under the current supply mode M2).

With this embodiment, it is possible to constitute an m-bit current-summing DA converter circuit through multiplying the current capacities of the Nch transistors QN1-QNm by 1, 2, 4, - - - , $2^m$. Alternatively, the reference current source I1 may be provided for each bit. Further, the current-summing DA converter circuit illustrated in the embodiment is merely an example, and the signal response switches G1-Gm may be omitted for a case where only the equivalent electric current is to be copied, for example.

Now, the current output part A shown in FIG. 1A is illustrated as a six-terminal circuit device as shown in FIG. 1B. In FIG. 1B, the current output part A comprises a reference current input terminal IREF, a voltage input terminal VREF, current output terminals IOUTA, IOUTB, a control signal input terminal CTL, and a signal input terminal DATA. The reference input terminal IREF is connected to the reference current source I1, and receives electric currents inputted from the reference current source I1 under the voltage supply mode M1 and the current supply mode M2. The voltage input terminal VREF is connected to the voltage supply source V1, and receives a reference voltage under the voltage supply mode M1. When the current output terminal IOUT turns to the current output mode M3, the current output terminals IOUT output the electric current stored under the current supply mode M2. The control signal input terminal CTL receives inputs of control signals for controlling the operation states, and performs control for switching the current output switches So1, So2, the current input switch Sw1, the calibration switch Sw2, the high-speeding switch Sw3, and the signal response switches G1-Gm within the current output part A. The signal input terminal DATA receives inputs of the input signals of m bits for controlling the output current values, and performs control for switching the signal response switches G1-Gm.

Next, actions of the current output part A according to the embodiment that is constituted in the above-described manner will be described by referring to the timing chart of FIG. 2. FIG. 2 illustrates the above-described three operation modes (the voltage supply mode M1, the current supply mode M2, and the current output mode M3). The conductive state of the switch is shown with "H", and the nonconductive state thereof is shown with "L". Further, "V (N2)" indicates the voltage V (N2) of the node N2. The voltage V (N2) of the node N2 according to the embodiment is illustrated with a solid line and the state of the voltage in the case of a conventional technique where the calibration only with the current supply mode M2 is started simultaneously is illustrated with a broken line.

Before calibration, the current output part A sets the current output switch So1 to be in a conductive state, and outputs, from the current output terminal T1, the output currents according to the states of the signal response switches G1-Gm which are controlled by the voltage V (N2) of the node N2 and the input signals. The current output switch So2, the current input switch Sw1, the calibration switch Sw2, and the high-speeding switch Sw3 are in a nonconductive state.

During the whole calibration period, the current output switches So1, So2 are set to be in a nonconductive state, and the signal response switches G1-Gm for selecting the electric currents from the Nch transistors QN1-QNm are all set to be in a conductive state. Details thereof are as follows. Under the voltage supply mode M1, the current input switch Sw1, the calibration switch Sw2, and the high-speeding switch Sw3 are set to be in a conductive state so as to supply the reference current and the reference voltage to charge the voltage holding capacitance element C1 from the node N2. Under the current supply mode M2, the high-speeding switch Sw3 is turned to a nonconductive state from the states of the switches under the voltage supply mode M1. Through this, only the electric current from the reference current source I1 is to be supplied to the Nch transistors QN1-QNm, and the voltage V (N2) of the node N2 is determined according to the above-described actions. The voltage (N2) of the node N2 corresponds to a voltage that is capable of passing an electric current that is equivalent to the reference current by the reference current source I1 through the Nch transistors QN1-QNm under such a condition that all the Nch transistors QN1-QNm are in a conductive state. AS a result, the current output part A comes to store the reference current by the reference current source I1.

After completing the calibration described above, first, the current input switch Sw1 and the calibration switch Sw2 are turned to a nonconductive state so that the voltage holding capacitance element C1 comes to hold the electric charge. That is, the voltage V (N2) of the node N2 is maintained. Thereafter, the current output switch So2 is turned to a conductive state to output, from the current output terminal T2, the sum of the electric currents that are selected by the signal response switches G1-Gm based on the input signals.

In the explanations above, the current input switch Sw1 and the calibration switch Sw2 are turned to a conductive state to achieve high-speed actions under the voltage supply mode M1. However, even if the current switch Sw1 and the calibration switch Sw2 are in a nonconductive state, it is also possible to achieve faster convergence compared to the case of the conventional technique, and to reduce the electric current by the amount of the reference current source compared to the above-described case.

Next, the overall structure of the current driving device according to the embodiment will be described by referring to FIG. 3. This current driving device comprises: n-numbers of output terminals OUT1-OUTn; (n+1)-numbers of current output parts A0-An; a reference current supply transistor QP1 that constitutes a first current supply part; a reference current supply transistor QP2 that constitutes a second current supply part; a voltage supply source V1; an action control circuit B; a signal input circuit Din; current-voltage converting transistors QNx, QPx; a reference current source I1; and a reset switch Sw4. Each of the current output parts A0-An is the current output part shown in FIG. 1A. A reference current input terminal IREF is connected to the reference current supply transistor QP1, and a voltage input terminal VREF is connected to the voltage supply source V1. An action control terminal CTL receives signals for controlling the action states, which are inputted from the action control circuit B. A signal input terminal DATA receives signals for controlling the output current values from the signal input circuit Din. Each of current output terminals IOUTA and IOUTB is connected to one of the output terminals OUT1-OUTn, and outputs an output current corresponding to the reference current and the input signal DATA to the outside in accordance with the state of the control signal CTL. The reference current supply transistor QP1 is connected between the IREF terminals of the current output parts A0-An and a power supply terminal, and a gate terminal thereof is connected to a node N11. The reference current supply transistor QP2 is connected between a node N12 and the power supply terminal, and a gate terminal thereof is connected to the node N11. The P-channel-type current-voltage converting transistor QPx is connected between the reference current source I1 and the power supply terminal, and a gate terminal thereof is short-circuited with its drain. The N-channel-type current-voltage converting transistor QNx is connected between the reference current supply transistor QN2 and a ground terminal, and a gate terminal thereof is short-circuited with its drain. The reset switch Sw4 is connected between the node N12 and the ground terminal.

Note here that connections of the current output terminals IOUTA and IOUTB of the current output parts A0-An are allocated according to the following rules. The current output terminal IOUTA of the current output part A0 is not connected to the outside, and the current output terminal IOUTB is connected to the output terminal OUT1 of the current driving device. The current output terminal IOUTA of the current output part A1 is connected to the output terminal OUT1, and the current output terminal IOUTB is connected to the output terminal OUT2. The current output parts thereafter are connected in the same manner, and the current output terminal IOUTA of the current output part An is connected to the output terminal OUTn while the current output terminal IOUTB is not connected to the outside. That is, for the n-numbers of output terminals OUT1-OUTn, in the i-th current output part Ai among the (n+1)-numbers of current output parts A0-An, the current output terminal IOUTA is connected to the i-th output terminal OUTi, and the current output terminal IOUTB is connected to the (i+1)-th output terminal OUT(i+1). However, the current output terminal IOUTA of the first current output part A0 and the current output terminal IOUTB of the (n+1)-th current output part An are not connected to the outside.

It is not necessary for the first current output part A0 to have the current output switch So1 and the current output terminal T1, and for the (n+1)-th current output part An to have the current output switch So2 and the current output terminal T2.

There are one more numbers (n+1) of current output parts prepared for the n-numbers of the output terminals in this case. However, it is also possible to prepare two current output parts for a single output terminal, so that one of the output parts can be used as the current output and the other as the calibration. This makes it possible to supply the output current to the current output terminal at all times. Further, in a case where it is not necessary for all the output terminals to be in the current output state, the number of current output parts may be smaller than the number of output terminals.

The current-voltage converting transistor QPx functions as a current-voltage converting part. Upon receiving the electric current from the reference current source I1, the current-voltage converting transistor QPx generates, at the node N1, a gate voltage (first voltage) for allowing the electric current that is equivalent to the reference current of the reference current source to flow therethrough. The reference current supply transistors QP1 and QP2 whose gate terminals are connected to the node N11 supply the electric current proportional to the reference current of the reference current source I1 to the IREF terminals of the current output parts A0-An and the current-voltage converting transistor QNx, respectively.

The current-voltage converting transistor QNx receives the electric current that is proportional to the current value of the reference current source I1 from the reference current supply transistor QP2. Like the current-voltage converting transistor QPx, the current-voltage converting transistor QNx itself generates, at the node N12, a gate voltage for allowing the electric current supplied from the reference current supply transistor QP2 to flow therethrough.

Preferably, the current-voltage converting transistor QNx is constituted in such a manner that all the Nch transistors QN1-QNm shown in FIG. 1A are connected in parallel. Further, when the values of the electric currents supplied from the reference current supply transistors QP1 and QP2 have different values, the current-voltage converting capacity of the current-voltage converting transistor QNx may be set in accordance with a ratio of the current values supplied from the reference current supply transistors QP1 and QP2. That is, if the current value supplied from the reference current supply transistor QP2 is three times as large as the current value supplied from the reference current supply transistor QP1, three current-voltage converting transistors QNx, in each of which all the Nch transistors QN1-QNm within the current output part A are connected in parallel, are prepared. Through this, it is possible to generate, at the node N2, the voltage that is extremely close to the voltage that is generated at the gates of the Nch transistors QN1-QNm by the current output part A under the current supply mode M2.

The voltage supply source V1 supplies the voltage that is generated at the node N12 by the current-voltage converting transistor QNx in the manner described above to the VREF terminals of the current output parts A0-An.

Considering a case of applying the current driving device according the embodiment to an actual display panel, if there are 160 pixels in one line, the number of output terminals becomes 160 (n=160). Thus, 161 current output parts A are required. In a case of RGB colors, there are required three times as many as the number of the current output parts A0-An and the number of the signal input circuits Din. Furthermore, when the reference current is controlled individually for RGB, three sets of the reference current supply transistor QP1 and the voltage supply source V1 are required among the components of the current driving device shown in FIG. 3. The action control circuit B may be used in common or may be provided individually.

<Calibration Mode Mc>

The calibration mode Mc of the current driving device shown in FIG. 3 will be described.

The action control circuit B sets one of the current output parts A0-An to be under the calibration mode Mc. That is, the mode thereof is shifted from the voltage supply mode M1 to the current supply mode M2, and the other current output parts are set to be under the current output mode M3.

First, the current output part A0 is set to be under the voltage supply mode M1. Each of the current output parts A1-An is set under such a condition that the electric current is outputted from the current output terminal IOUTA to the output terminals OUT1-OUTn. Then, the current output part A0 is set to be under the current supply mode M2. No change is applied to the settings of the actions of the current output parts A1-An. Through the above, calibration of the current output part A0 is performed.

Next, the current output part A0 has the current output terminal IOUTB connected to the output terminal OUT1 to set the current output mode M3. No change is applied to the connections of the current output parts A2-An and the output terminals OUT2-OUTn. In this state, the current output part A1 is shifted from the voltage supply mode M1 to the current supply mode M2 to perform calibration.

In the same manner, the current output terminal IOUTA of the current output part before the calibration or the current output terminal IOUTB of the current output part after the calibration is connected to the output terminal so as to perform calibration successively for each of the current output parts.

<Current Output Mode M3>

Next, the current output mode M3 of the current driving device shown in FIG. 3 will be described.

The n-numbers of current output parts A that are not set under the calibration mode Mc are set under the current output mode M3, and receive display data signals from the signal input circuit Din according to the output terminals to which each of the current output parts A is connected. The current output part A set under the current output mode M3 outputs a sink current in accordance with the reference current and the aforementioned display data.

<Refresh>

In a case where the calibration is performed only once, the reference voltage held in the voltage holding capacitance elements C1 is fluctuated due to leaks in the voltage holding capacitance elements C1 and in the gates of the Nch transistors QN1-QNm within the current output parts A0-An. Thus, it is necessary to perform calibration for the current output parts periodically. Therefore, the embodiment provides (n+1)-numbers of current output parts A0-An for the n-numbers of output terminals OUT1-OUTn, and performs calibration on the current output part that is not in the mode of outputting the electric current.

The voltage close to the target voltage is being maintained after performing the calibration once on all the current output parts A0-An, except right after the startup or right after a change in the reference current. Thus, calibration under the voltage supply mode M1 may be omitted.

<Collective Voltage Supply Mode M1'>

In a case where only the periodic calibration described above and a refresh action are performed, it is not possible to obtain a perfect output unless the necessary voltages are held at the nodes N2 of each current output part, when it is right after the startup of the current driving device or there is a change in the reference current. Thus, non-uniformity is generated in a panel display. Therefore, there is provided an operation mode where the voltage supply source V1 collectively supplies a voltage to be generated by the current-voltage converting transistor QNx to the nodes N2 of all the current output parts A0-An at the time of the startup or changing the reference current. Through this, it becomes possible to store a current value that is close to a reference current that is set anew to all the current output parts A0-An, so that the non-uniformity in the display caused due to the successive calibration can be improved.

<Resetting of Reference Voltage>

As described above, each current output part is capable of provisionally holding the current value that is close to a new reference current because of the voltage supply source V1. However, the node N12 for supplying this voltage is charged by a source current from the reference current supply transistor QP2. The current-voltage converting transistor QNx is merely a load for the reference current supply QP2 that supplies the source current. Thus, especially when the reset reference current is very small, it is difficult for the voltages (?) to be converged to a low voltage. Therefore, it is desirable that a reset switch Sw4 is deposited to provide a function of short-circuiting the node N12 to a ground potential.

In the above-described embodiment, the reset switch Sw4 is connected between the ground potential and the current-voltage converting transistor QNx. However, by generating a lowest potential estimated as the potential of the current-voltage converting transistor QNx and connecting the reset switch Sw4 between the node of the generated potential and the current-voltage converting transistor QNx, the potential of the current-voltage converting transistor QNx can be reset still faster.

There is a large difference in the load from the viewpoint of the voltage supply source V1 between the case of performing the processing of the voltage supply mode M1 with the periodic calibration and the case of performing the processing of the collective voltage supply mode M1' described in this section. If the voltage supply capacity corresponding to the n-numbers of loads is used for charging a single current output part A, a voltage waveform of the voltage supply line is distorted, and problems such as EMI (electromagnetic interference) may be induced. Inversely, the voltage supply capacity corresponding to a single current output part is insufficient for supplying the voltage for all the current output parts. As a countermeasure for such problems, the voltage supply capacity of the voltage supply part may be varied in accordance with the extent of the capacitance to be charged.

As an example, there is such a type that the number of output-stage transistors within the voltage supply source V1 is varied in accordance with each of the operation modes described above. FIG. 4 shows an example of such case. The voltage supply source V1 is constituted with: a differential amplifier Ad; Nch transistors QN21, QN22; Pch transistors QP21, QP22; and switches Sw5, Sw6, Sw7, and Sw8. The differential amplifier Ad receives, at its inverting input terminal, a reference voltage generated by a current-voltage converting transistor QNx. The output terminal of the voltage supply source V1 is connected to a non-inverting input terminal thereof, so that the voltage supply source V1 as a whole constitutes a voltage follower. Further, current output parts A0-An are connected to the output terminal of the power supply source V1. Gates of the Nch transistors QN21 and QN22 are connected to the output terminal of the differential amplifier Ad, sources thereof are connected to a ground terminal, and drains thereof are connected to the output terminal of the voltage supply source V1 via the switches Sw5 and Sw6, respectively. A proper bias voltage is applied to gates of the Pch transistors QP21, QP22 from the outside, sources thereof are connected to a supply potential, and drains thereof are connected to the output terminal via the switches Sw7 and Sw8, respectively. When setting only one of the current output parts (for example, the current output part AO) to be under the voltage supply mode M1, the switches Sw5, Sw7 are set to be in a conductive state and the switches Sw6, Sw8 are set to be in a nonconductive state so as to provide the optimum state for having only the voltage holding part (the voltage holding capacitance element C1 of FIG. 1) of the current output part A0 as a load. When setting all the current output parts A0-An to be under the voltage supply mode M1, all the switches Sw5, Sw6, Sw7, and Sw8 are set to be in a conductive state to increase the voltage supply capacity so as to be able to charge the voltage holding capacitance elements C1 provided to all the current output parts. Through this, the voltage supply source V1 can supply the voltage with a proper voltage supply capacity in accordance with the load.

Figure 5:
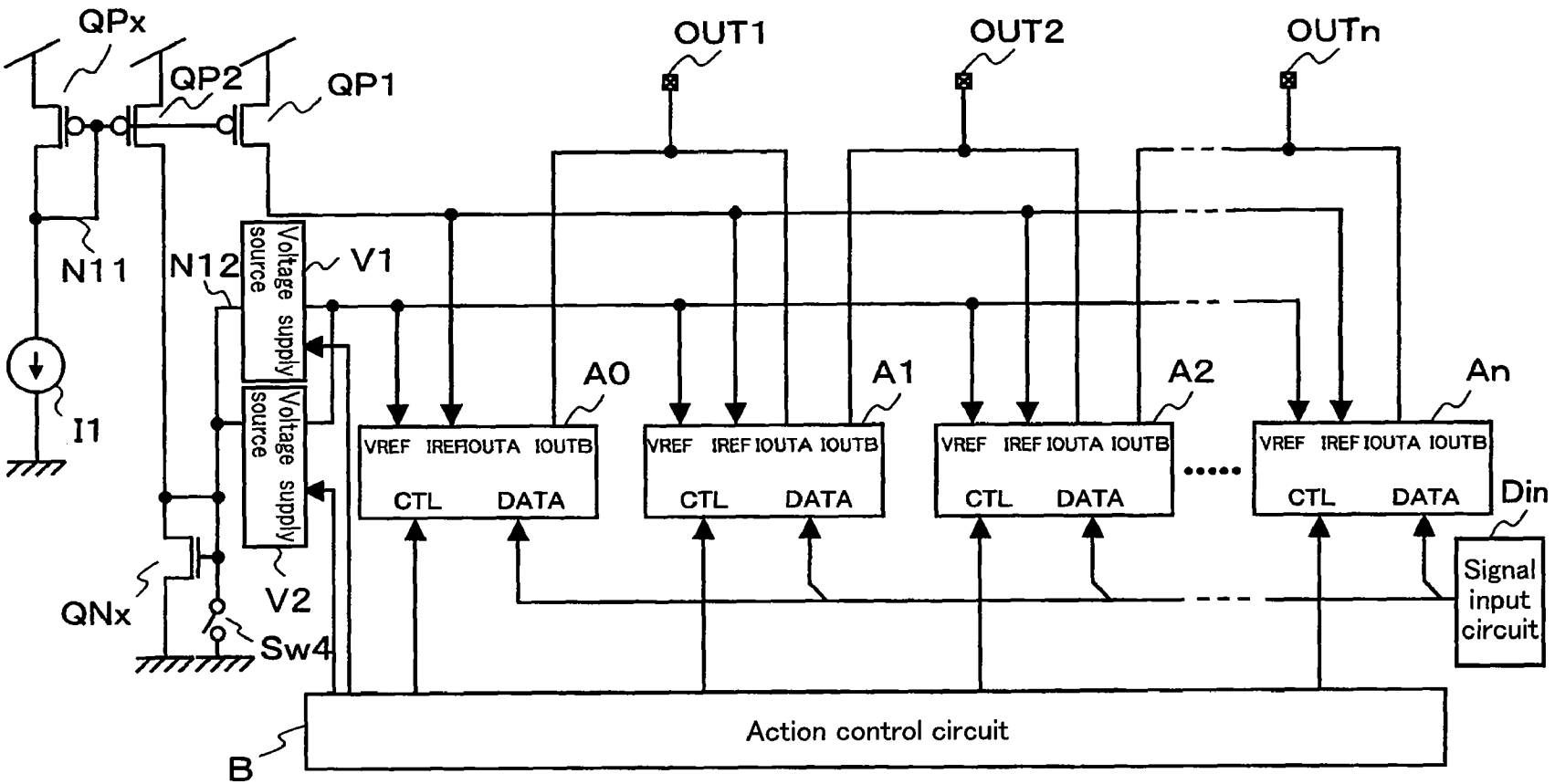
FIG. 5 is a block circuit diagram for showing an overall structure of a current driving device according to a modification example of the preferred embodiment of the present invention.

FIG. 5 is a circuit diagram for showing a structure of a current driving device according to another embodiment of the present invention. In this embodiment, a second voltage supply part having a different voltage supply capacity is provided for each of the operation modes, i.e. the periodic voltage supply mode M1 and the collective voltage supply mode M1'. That is, in addition to the voltage supply source V1 as the first voltage supply part that has a proper voltage supply capacity for a single load of the current output part, the embodiment comprises a voltage supply source V2 as the second voltage supply part that has a proper voltage supply capacity for all the connected current output parts as the loads. Control signals are inputted to the voltage supply sources V1 and V2 from an action control circuit B. Each of the voltage supply sources V1 and V2 has a node N12 exhibiting a first voltage as the input, and is switch-controlled depending upon whether the mode is set as the voltage supply mode M1 for a single current output part or the collective voltage supply mode M1'. Furthermore, by providing an over lapped period when switching the actions of both voltage supply sources, it is possible to suppress a large fluctuation in the output waveform right after switching the modes.

<Effects>

Through the above-described structures, in the current driving device that performs calibration of the current output parts through supplying a reference current, it becomes possible to speed up the calibration action by supplying a voltage that is close to the final target value before the calibration executed by using the reference current. This makes it possible to deal with a case where the reference current is very small and a case where the number of outputs of the current driving device is increased in accordance with an increase in the scale of panel.

In FIG. 1A, the output current of the current output part is a sink current and Nch transistors are used as the structural elements. In a case where the output current is a source current, however, Pch transistors may be used instead.

While the invention has been described and illustrated in detail, it is to be clearly understood that this is intended be way of illustration and example only and is not to be taken by way of limitation, the spirit and scope of this invention being limited only be terms of the following claims.

What is claimed is:

1. A current driving device, comprising:

a first voltage supply source for supplying a first voltage;

a first current supply source for supplying a first electric current;

a plurality of output terminals; and a plurality of current output circuits for outputting an electric current in accordance with said first electric current, each of said current output circuits comprising a current-voltage converting circuit, a voltage-current converting circuit, a voltage holding circuit having a terminal being connected to a reference voltage different from the first voltage, and at least one current output terminal, wherein:

each of said current output circuits operates in three operation modes including a voltage supply mode, a current supply mode, and a current output mode, under said voltage supply mode, each of said current output circuits receives said first voltage from said first voltage supply source, and the first voltage is supplied to another terminal of said voltage holding circuit, under said current supply mode, each of said current output circuits receives said first current from said first current supply source, and generates a second voltage by said current-voltage converting circuit, and the first current is supplied to said another terminal of said voltage holding circuit, and under said current output mode, each of said current output circuits outputs an output current according to said voltage held in said voltage holding circuit by said voltage-current converting circuit.

2. The current driving device according to claim 1, wherein:

each of said output terminals is connected to said current output terminals provided to said plurality of said current output circuits, and each of said plurality of current output circuits is connected in parallel to said first current supply source and said first voltage supply source used in common.

3. The current driving device according to claim 1, wherein, in each of said current output circuits, said current-voltage converting circuit is actuated under said voltage supply mode.

4. The current driving device according to claim 1, wherein each of said current output circuits is configured to stop said current-voltage converting circuit under said voltage supply mode.

5. The current driving device according to claim 1, further comprising:

a second current supply source for supplying a second electric current that is proportional to said first electric current; and a second current-voltage converting circuit for generating said first voltage by receiving said second electric current, wherein said first voltage supply source controls supplies of said first voltage generated by said second current-voltage converting circuit to said current output circuits.

6. The current driving device according to claim 5, wherein said second current-voltage converting circuit comprises a switching part for short-circuiting a node at which said first voltage emerges to a reference voltage node.

7. The current driving device according to claim 1, further comprising a second voltage supply source with a larger voltage supply capacity than that of said first voltage supply source, wherein the use of said first voltage supply source and the use of said second voltage supply source are switched in accordance with the number of said current output circuits that operate in said voltage supply mode among said plurality of current output circuits.

8. The current driving device according to claim 1, wherein said first voltage supply source is configured to change its voltage supply capacity in accordance with the number of said current output circuits that operate in said voltage supply mode among said plurality of current output circuits.

9. A current-driving-type display device, comprising said current driving device according to claim 1 mounted thereon so as to be driven by said current driving device.

10. A current driving device, comprising:

a current input switch for controlling connection/disconnection states with respect to a current supply source;

a voltage holding circuit for holding a reference voltage, which is charged by a flown current, the voltage holding circuit having a first terminal and a second terminal, the first terminal being connected to a fixed voltage;

a calibration switch interposed between said current input switch and said voltage holding circuit;

a plurality of voltage-current converting elements for generating an electric current in accordance with said reference voltage held in said voltage holding circuit;

a plurality of signal response switches that are on/off controlled in accordance with inputted signals, each of said response switches being connected in series to a corresponding one of said voltage-current converting elements, and each of which being connected in parallel to said calibration switch;

a connection node provided between said current input switch and said calibration switch;

a plurality of current output switches, each being interposed between the connection node and said plurality of current output terminals; and a high-speed switch for controlling connection/disconnection states of said voltage supply source with respect to the second terminal of said voltage holding circuit.

* * * * *